US006170375B1

(12) United States Patent
Fidziukiewicz

(10) Patent No.: US 6,170,375 B1
(45) Date of Patent: Jan. 9, 2001

(54) BUMP CAM

(75) Inventor: Erich D. Fidziukiewicz, South Lyon, MI (US)

(73) Assignee: Lamina, Inc., Oak Park, MI (US)

( * ) Notice: Under 35 U.S.C. 154(b), the term of this patent shall be extended for 0 days.

(21) Appl. No.: 09/271,133

(22) Filed: Mar. 17, 1999

(51) Int. Cl.[7] ..... B26D 5/08

(52) U.S. Cl. ..... 83/627; 83/698.91; 83/699.41; 83/824

(58) Field of Search ..... 83/588, 678, 635, 83/638, 824, 627, 698.91, 699.41

(56) References Cited

U.S. PATENT DOCUMENTS

| | | | | |
|---|---|---|---|---|
| 2,340,162 | * | 1/1944 | Whistler et al. | 83/588 |
| 3,245,694 | * | 4/1966 | Parker | 83/698.31 |
| 3,473,425 | * | 10/1969 | Foist et al. | 83/129 |
| 3,541,909 | * | 11/1970 | Franzen | 83/588 |
| 3,589,226 | * | 6/1971 | Shadowens, Jr. | 83/698.31 |
| 4,471,680 | * | 9/1984 | Gerhart | 83/588 |
| 4,621,512 | * | 11/1986 | Tachikawa et al. | 72/325 |
| 4,726,270 | * | 2/1988 | Lucas | 83/698.31 |
| 5,038,599 | * | 8/1991 | Wellman | 83/698.31 |
| 5,099,708 | * | 3/1992 | Chung | 83/635 |
| 5,101,705 | * | 4/1992 | Matsuoka | 83/627 |
| 5,197,368 | * | 3/1993 | Meyer et al. | 83/698.31 |
| 5,410,932 | * | 5/1995 | Moellering | 83/698.31 |
| 5,678,468 | * | 10/1997 | Bonet et al. | 83/824 |

OTHER PUBLICATIONS

Document entitled External Cam Unit Information, IEM Division of Connell Limited Partnership (9pages, double–sided), 1992.

* cited by examiner

*Primary Examiner*—Rinaldi I. Rada
*Assistant Examiner*—Omar Flores-Sánchez
(74) *Attorney, Agent, or Firm*—Brooks & Kushman P.C.

(57) ABSTRACT

A bump cam is provided with a sacrificial force transmitting block disposed between the driver and the tool holder and floatingly coupled to the tool holder whereby lateral loading imposed on the block by the driver is not transmitted to the tool holder.

8 Claims, 2 Drawing Sheets

BUMP CAM

This invention relates to devices for shaping, trimming, and punching sheet metal or the like utilizing what are referred to in the trade as bump cams.

BACKGROUND OF THE INVENTION

In conventional bump cams, a driver is pushed downwardly by an upper die into the bump cam housing. The driver has an inclined lower end which engages a complimentary inclined end of a tool holder. As the driver moves downwardly, the inclined surfaces cause a tool carried by the tool holder to be shifted outwardly to punch a hole, for example, in the sheet metal workpiece. After a period of time, the laterally directed loading imposed on the tool holder by the inclined face of the driver causes a wearing of the bearing surfaces between the tool holder and the bump cam housing, and the tool carried by the tool holder will drift off center so that the hole being punched will not be in the proper location.

In addition, the construction of conventional bump cams causes a high unit loading at the bearing surfaces within the bump cam that leads to rapid wear and shorter cam life.

SUMMARY OF THE INVENTION

I have designed a bump cam that reduces or substantially eliminates the abuse of the tool holder by the driver which formerly lead to off-center operation of the tool held by the tool holder. In addition, my design enables the alteration of the speed of tool movement and loading of the bump cam without disturbing the design of the tool holder.

These desirable results are obtained by utilizing a sacrificial force transmitting block between the driver and the tool holder which essentially eliminates the lateral loading on the tool holder which was heretofore imposed by the inclined face of the driver engaging a complimentary face of the tool holder. One portion of the sacrificial block has an inclined surface complementing the inclined surface of the driver and another portion floatingly engages the tool holder to push it outwardly without imposing a lateral loading thereon. As a result, my improved bump cam can operate over long periods without causing a tool carried by the holder to be laterally displaced from its proper position vis-a-vis the workpiece.

In addition, when the sacrificial block has become sufficiently worn at its bearing surfaces to impair operation of the bump cam, the block can be simply replaced in the bump cam at a much lower cost than replacing the entire bump cam, as was necessary in the conventional bump cams of the prior art.

Additionally, my design allows an increase in the tonnage capacity of the bump cam without a massive increase in the size of the unit. This is accomplished by increasing the surface area at the inclined interface between the driver and the sacrificial block and does not disturb the tool holder.

These and other advantages will become apparent to those skilled in this art from the following description.

BRIEF DESCRIPTION OF THE PREFERRED EMBODIMENT

Figure 1:
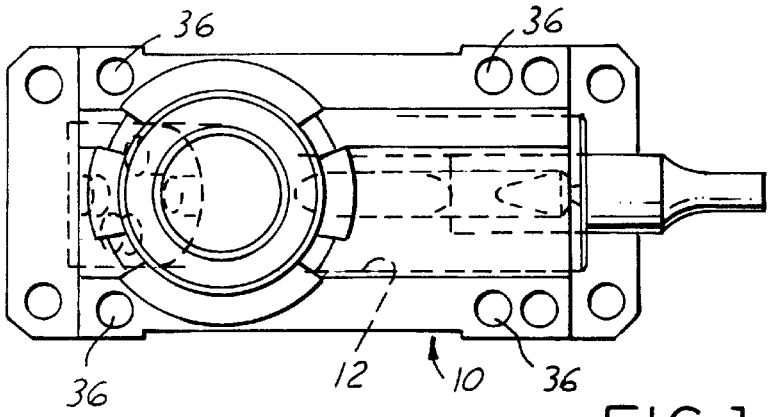
FIG. 1 is a top plan view of my improved bump cam.
Figure 2:
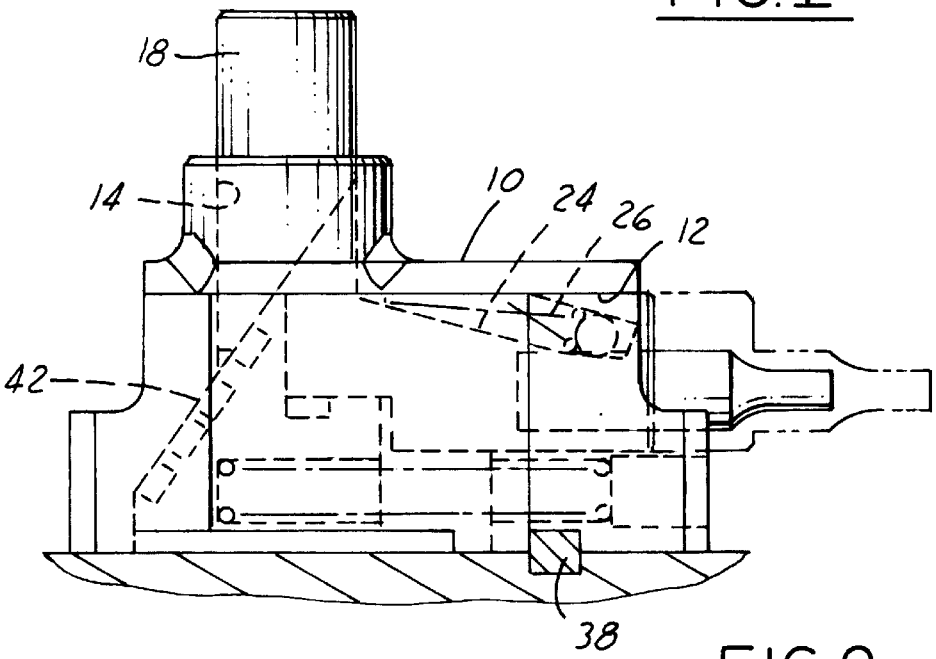
FIG. 2 is a side elevation of my improved bump cam showing a tool in solid outline in a retracted position and a phantom outline in an extended position.

A bump cam embodying my invention comprises a housing 10 which may be a casting containing a pair of angularly intersecting passageways 12 and 14, each opening outwardly at one end through the housing. Passageway 12 is adapted to receive a tool holder 16 for accurately guided rectilinear reciprocation, Passageway 14 receives a driver 18 for vertical reciprocation. In the embodiment shown, the passageways are at a right angle to each other.

The tool holder is shown as carrying a punching tool (or simply a punch) 20, which is received in a bore 27 in the holder and held therein by a quick-release catch mechanism. The catch comprises a ball 22 in a short passage 24. The ball is urged toward a tool-locking position by a coil spring 26. The tool has a notch 28 therein into which the ball is urged by the spring 26. By simply inserting the shank 30 of the tool into the passage, the tool is locked therein. To release the tool, a small diameter rod (not shown) is inserted in the passageway 32 and pressed against the ball 22 to disengage it from the notch 28 and while so disengaged the tool may be extracted from the passageway 27.

While I have shown a punch in the drawings, it should be understood that any suitable tool may be mounted on the tool holder. In addition, while I have shown a tool-mounted in what has been referred to as a tool holder, the tool holder shown in the drawings may comprise a carrier upon which a tool holder is mounted to carry a tool. The theory of operation is, in any event, the same.

The housing 10 is intended to be mounted on the base member 34 of the die mechanism and held thereto by fasteners whose heads are shown at 36. A key 38 is received in the base member 34 and in the housing 10, which with the fasteners, lock the bump cam on the base member 34. In the bottom of the housing 10 is a bearing plate 40 which may be provided with lubricating pads (not shown). The plate slidably supports a sacrificial force transmitting block 42 disposed at the intersection between the passageways 12 and 14. The block has a first portion provided with an angularly disposed wear face 44 provided with lubricating pads 46 similar to the pads (not shown) in the bearing plate 40. The angularly disposed wear face 44 abuts a similarly inclined driving face 48 on the driver 18. The faces 44 and 48 define an inclined interface between the driver and the block. The bottom face 43 of the block 42 which bears on the plate 40, may be provided with lubricating pads 46 similar to the pads 46.

Figure 4:
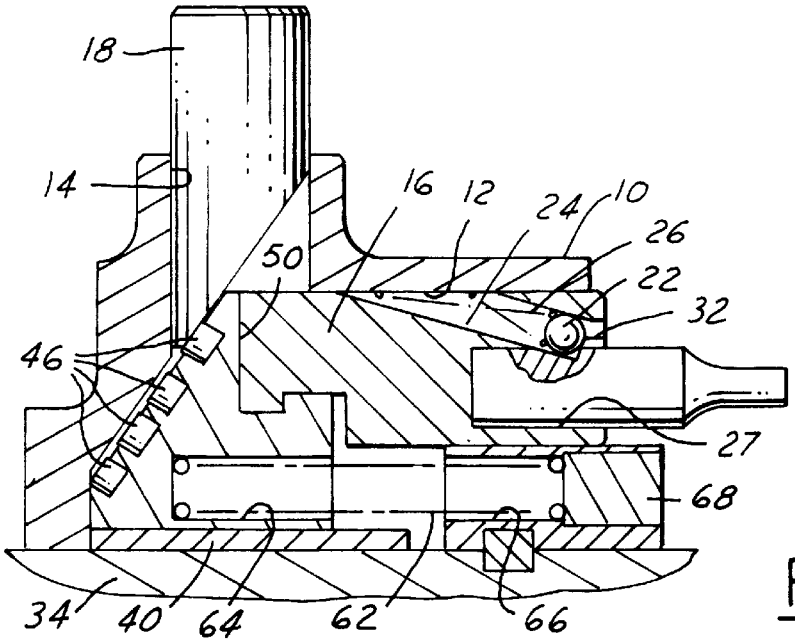
FIG. 4 is a side elevation in cross-section of my improved bump cam in showing the tool in the retracted position.
Figure 5:
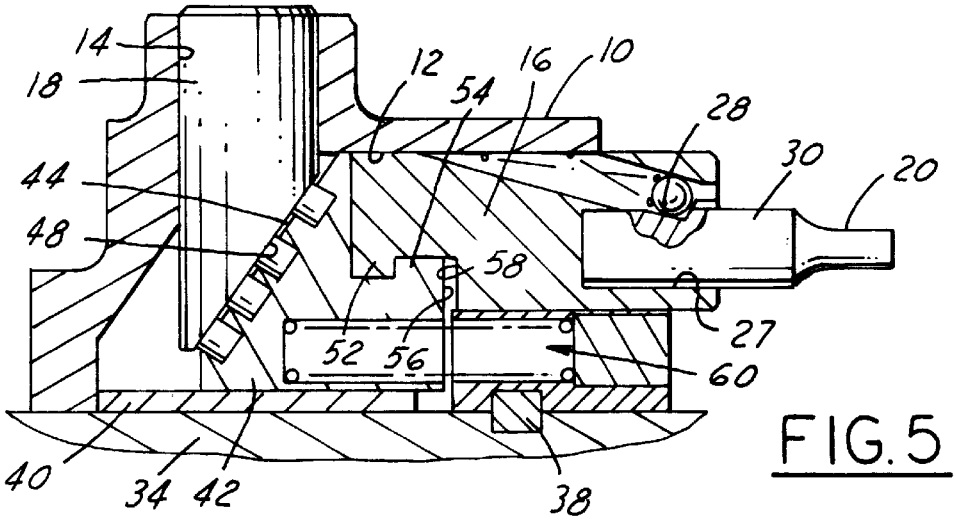
FIG. 5 is similar to FIG. 4 but shows the tool in the extended position.
Figure 6:
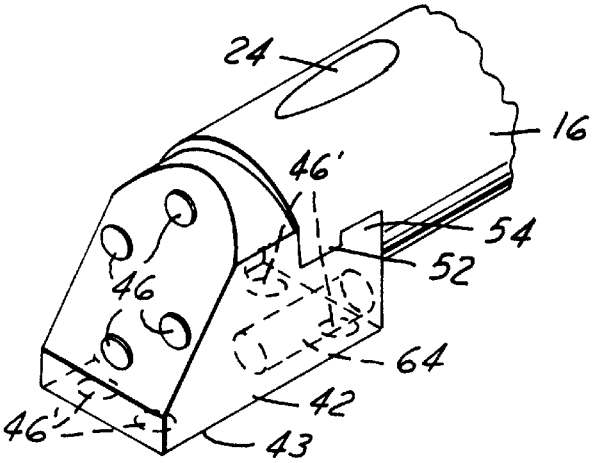
FIG. 6 shows the connection between the sacrificial block and the tool holder.

The block has another portion which floatingly couples it to the tool holder 16 as best shown in FIGS. 4, 5 and 6. The block urges the tool holder outwardly of the housing from the position shown in FIG. 4 to that shown in FIG. 5, and also draws the tool holder back into the housing from the position of FIG. 5 to that of FIG. 4. The floating connection between the block and the tool holder includes intermitting portions of the block and tool holder, i.e., the block and tool holder meet at a flat interface 50 disposed perpendicular to the axis of reciprocation of the tool holder and tool carried thereby. The block and tool holder have interfitting notches 52 and 54 preventing relative rotation or axial separation between the block and tool holder. However, it will be noted that the notches 52 and 54 open in such a way that them together with the interface 50, permit relative movement between the block 42 and the tool holder 16, perpendicular to the rectilinear movement of the tool holder, whereby a lateral loading imposed on the block by the driver will not be transmitted to the tool holder.

Figure 3:
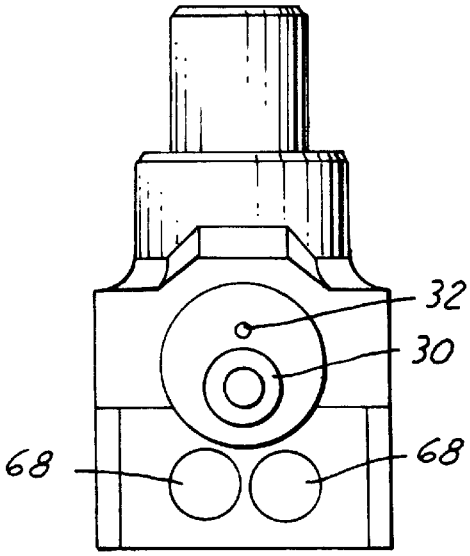
FIG. 3 is an end view of my improved bump cam.

The block and tool holder have opposed spaced apart faces 56 and 58 such that the forces transmitted between the block and tool holder are at the interface 50 rather than at the faces 56 and 58. A force returning mechanism 60 reacts between the housing 10 and the block to return the block from the FIG. 5 to the FIG. 4 position after the tool has completed its stroke against the workpiece and the upper die (not shown) rises. Such mechanism may take a variety of forms and the exemplary design shown herein comprises a pair of coil compression springs 62 disposed in suitable recesses 64 in the block and aligned recesses 66 in the tool holder, the latter being closed by plugs 68 shown in FIGS. 3 and 4.

The block 42 has parallel planar side faces, one of which is shown in 45, which engage opposed walls in the housing 10. The top 47 of the block engages the top of the passageway 12. The engaged surfaces 45 (with opposed walls in the housing), surface 43 of the block resting on the bearing plate 40, and the top of the block 47 engaging the top of the passageway, prevent rotation of the block in the housing. In turn, the interfitting notches 52 and 54 between the block and tool holder prevent rotation of the tool holder in the housing.

When the upper die (not shown) moves downwardly and strikes the driver 18, it pushes the driver down into the housing and moves the block to the right as shown in FIGS. 4 and 5. This projects the tool to the right to effect a punching action or other treatment of a workpiece (not shown). Upon raising the upper die, the block is moved to the left retracting the punch and raising the driver, all under the urging of the force-returning mechanism.

It should be noted that with this construction and arrangement, the lateral loading imposed on the sacrificial block by the driver as it descends, is not transferred to the tool holder but is carried by the block and in turn the wear pad 40 which is located directly beneath the interface provided by the inclined faces 44 and 48 of the block and driver, respectively. Thus, the useful life of the tool holder is not only extended, but repetitive accuracy in the operation of the tool is ensured.

It will also be apparent that the speed, and the loading on the tool holder, may be varied by simply providing different blocks and drivers having different inclined faces 44 and 48, all without disturbing the tool holder.

While embodiments of the invention have been illustrated and described, it is not intended that these embodiments illustrate and describe all possible forms of the invention. Rather, the words used in the specification are words of description rather than limitation and it is understood that various changes may be made without departing from the spirit and scope of the invention.

What is claimed is:

1. In a bump cam, the combination comprising:

a housing having a pair of angularly intersecting passageways each opening outwardly at one end through the housing;

a driver slidably received in one passageway and having an angularly disposed driving face;

a tool holder slidably received in the other passageway and closely supported therein for accurately guided rectilinear movement; and a sacrificial force transmitting block received in said housing at the intersection of said passageways and having an angularly disposed face engaged with the angularly disposed face of the driver along an inclined interface therebetween; and said block and tool holder having interfitting portions floatingly coupling the block and holder together for relative movement therebetween perpendicular to the rectilinear movement of the tool holder to shift the tool holder in its passageway outwardly of the housing upon depression of the driver without imposing a lateral loading on the tool holder affecting its closely guided movement.

2. The invention defined by claim 1 wherein a force returning mechanism is disposed in the housing for shifting the tool holder inwardly in its passageway and raising the driver.

3. The invention defined by claim 2 wherein the force return mechanism reacts between the housing and the block.

4. The invention defined by claim 1 wherein a self-lubricating bearing surface is disposed beneath the sacrificial force transmitting block opposite the driver.

5. The invention defined by claim 1 wherein a self-lubricating bearing surface is disposed at the inclined interface.

6. The invention defined in claim 5 wherein a self-lubricating bearing surface is disposed beneath the force transmitting sacrificial block opposite the driver.

7. The invention defined in claim 1 wherein the tool holder is provided with a quick release tool retainer for holding a tool on the tool holder.

8. The invention defined by claim 1 wherein the passageway for receiving the tool holder is cylindrical and the tool holder has a cylindrical portion mating with its passageway, and the sacrificial force transmitting block and the housing have opposed engaged relatively sliding planar surfaces preventing rotation of the block, and said block and tool holder have interfitting planar portions preventing axial separation and relative rotation between the block and tool holder, whereby the tool holder is prevented from rotating in its passageway.

* * * * *